United States Patent [19]

Ohnmacht

[11] 4,109,138

[45] Aug. 22, 1978

[54] FAN-HEATER APPLIANCE WITH ADJUSTABLE FAN SPEED

[75] Inventor: Helmut Ohnmacht, Kandel, Pfalz, Fed. Rep. of Germany

[73] Assignee: Firma Fritz Eichenauer, Fed. Rep. of Germany

[21] Appl. No.: 705,275

[22] Filed: Jul. 14, 1976

[30] Foreign Application Priority Data

Jul. 16, 1975 [DE] Fed. Rep. of Germany ..... 2531687

[51] Int. Cl.[2] ..... F24H 3/04; A45D 20/10; H05B 3/02

[52] U.S. Cl. ..... 219/364; 34/97; 132/9; 219/370; 219/375; 338/58; 338/194

[58] Field of Search ..... 219/363, 364, 369, 370, 219/379, 380, 374–376, 381, 382, 541, 371, 373; 338/185–194, 323, 325, 57, 58, 280–284, 290, 291; 34/90, 91, 96–101, 243 R; 132/9, 11 R

[56] References Cited

U.S. PATENT DOCUMENTS

| | | | |
|---|---|---|---|
| 1,367,631 | 2/1921 | Smith | 338/194 X |
| 1,709,808 | 4/1929 | Quern | 219/375 X |
| 1,816,055 | 7/1931 | Pfeifer | 219/371 |
| 2,834,867 | 5/1958 | White | 338/290 X |

FOREIGN PATENT DOCUMENTS

| | | | |
|---|---|---|---|
| 2,307,992 | 8/1974 | Fed. Rep. of Germany | 34/96 |
| 196,680 | 8/1938 | Switzerland | 338/194 |
| 1,456,782 | 11/1976 | United Kingdom | 219/370 |

*Primary Examiner*—A. Bartis
*Attorney, Agent, or Firm*—Craig & Antonelli

[57] ABSTRACT

A fan-heater appliance, e.g., hair drier, has a tapping arrangement for providing a variable supply to a fan motor to regulate the speed thereof. The tapping arrangement comprises a current collector which is slidable over a row of heads of tubular rivets which are attached to the coil tips of a linearly coiled resistance heating wire arranged transversely of the air flow path through the appliance. The current collector is operated by a crank arrangement including a knurled disc operator.

5 Claims, 4 Drawing Figures

FAN-HEATER APPLIANCE WITH ADJUSTABLE FAN SPEED

The invention relates to electrical heating elements for fan-heater appliances — for example hair driers, fan heaters, or the like — comprising a resistance heating wire coiled linearly e.g. in zig-zag or sinuously coiled manner with a row of coils, or several rows of coils situated one behind another, transverse to the incident flow direction of the air and with two holding plates which are arranged parallel to the incident flow direction and which fix rows of coils between themselves.

In such heating elements a fan is necessary for producing an air flow through the row or rows of coils. The fan motor, which in hair driers is usually designed for connection to a low voltage, may be connected by means of a voltage pick-up to the coil tips. Since the total power of the heating element is usually divided into at least two power groups, a step switching arrangement may also be required for the fan motor.

Furthermore it is desirable to allow individual (i.e. steplessly variable) adjustment of the air flow, i.e. of the fan speed, by the user to suit the various requirements when dealing with the hair.

Heating elements as described above have been proposed in German patent specification Nos. 1,185,743 and 1,256,335. Heating elements of this kind have also been proposed wherein the current supply arrangement to the low-voltage fan motor is achieved by providing additional resistance sections in the heating element. It has also been proposed that the voltage required for the fan motor be tapped at the coil tips by means of tubular rivets, and that the fan motor be controlled in two stages by the interposition of a diode. It has also already been proposed to effect stepless adjustment electronically: for this purpose, base resistances are to be integrated in the heating element or additionally provided. These additional devices are very involved, lead to considerable cost, require considerable space for accommodating them, and constitute possible sources of error leading to failures.

The invention has as its object to reduce to a minimum the outlay for regulating a low-voltage fan motor and at the same time to allow almost stepless speed adjustment over a relatively large rotational speed range.

According to the present invention there is provided an electrical heating element for a fan-heater appliance, comprising a resistance heating wire coiled linearly, e.g. sinuously or in zig-zag fashion, with a row of coils, or several rows of coils situated one behind another, transverse to the incident air flow direction and with two holding plates which are parallel to the incident flow direction and which secure between themselves the row or rows of coils, wherein a plurality of tips of the coils each have a tubular rivet placed on them with the heads of all the tubular rivets are arranged in a plane, and a current collector is provided which is capable of being displaced in electrically conductive contact over the tubular rivets.

The current collector or tap is moved over the contacts formed of the tubular rivets in similar manner to a slide of a variable resistance, supplying to the fan motor the particular voltage tapped at the time. Tapping a plurality of short resistance sections ensures an approximately uniform regulation. Thus the air flow of the fan can be adapted to the needs of the particular person operating the appliance at the time. The current collector disposed over the tapping points can be moved by a crank arrangement operated by a knurled disc. This knurled disc is so mounted in the housing that it projects at least partly out of the housing of the appliance.

An embodiment of the invention will now be described, by way of example, with reference to the accompanying drawings wherein.

Figure 1:
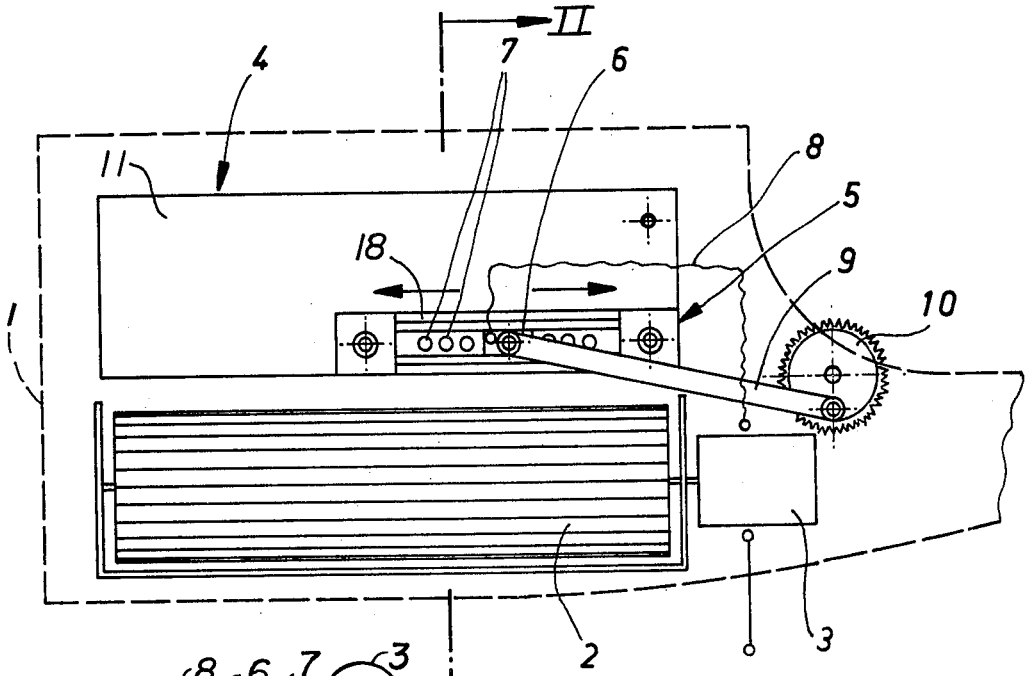
FIG. 1 is a diagrammatic plan view of a hair drier.
Figure 4:
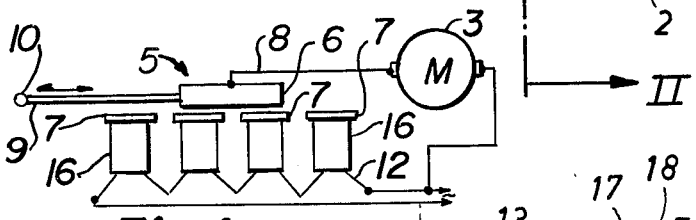
FIG. 4 is a circuit diagram showing the electrical relationship of the parts of the hair drier.

FIG. 1 shows an appliance housing 1 with a fan 2 and a driving motor 3, also a heating element 4 and a control device 5. The control device 5 comprises a current collector 6 which is capable of being displaced over the heads of tubular rivets 7 to tap the desired resistance section. The current collector 6 is connected to the fan driving motor 3 by way of a loosely connected lead 8. The current collector 6 is connected by way of a connecting rod 9 to a crank-pin on a knurled disc 10 which is mounted to be capable of rotating in the appliance housing 1. The connecting rod 9 and disc 10 form a sliding controller for operating the current collector. By turning the knurled disc 10 the current collector 6 can be moved in the direction indicated by means of arrows.

Figure 2:
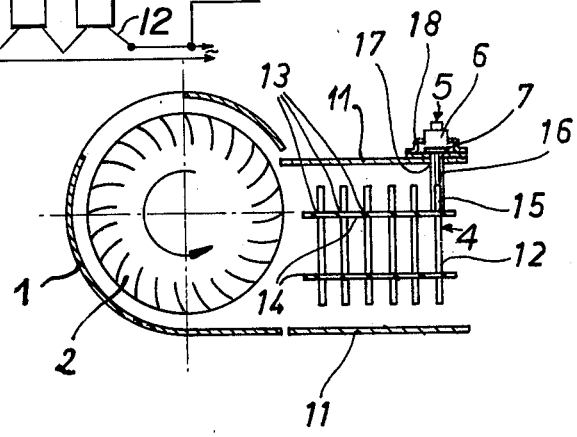
FIG. 2 is a section on II—II of FIG. 1.
Figure 3:
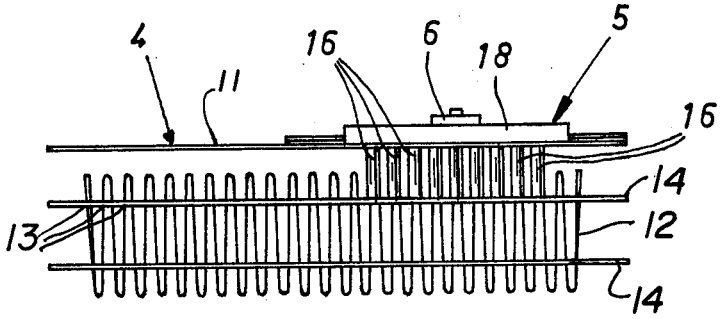
FIG. 3 is a diagrammatic front view of an electrical heating element in the hair drier.

FIGS. 2 and 3 show more details of the construction of the heating element 4. Between cover plates 11, coils 12 disposed in zig-zag formation are taken through holes 13 in holding plates 14 and fixed in position. There are several rows of coils 12, the rows being situated one behind another. Tubular rivets 16 are fitted on to the coil tips 15 of the forward coil row and may be pressed flat, these rivets extending through the cover plate 11 in holes 17 provided for this purpose. The tubular rivets 16 are flattened by upsetting at their upper end to give them a kind of head. The current collector 6 sliding over the flattened tubular rivets 7 is guided in an electrically insulated rail 18.

FIG. 3 shows the front view of the heating element 4 with the tubular rivets 16 provided as tapping points for the control device 5 provided by the present invention, from which it will be appreciated that the tapping arrangement provides for almost stepless variation of the tapped voltage and therefore of the motor speed.

What is claimed is:

1. A fan-heater appliance, comprising a housing, a low voltage fan motor for producing a flow of air within said housing, a resistance heating wire coiled linearly to form a series of tips with at least one row of coils transverse to the direction of said air flow, and means for securing said at least one row of coils within said housing, a plurality of the tips of the coils being each placed within a respective headed tubular rivet with the heads of all the tubular rivets being arranged in a continuous path, and a current collector connected in an electrical circuit with said fan motor, said current collector being moveable along said path in electrically conductive contact with selected ones of the heads of the tubular rivets and means for selectively displacing said current collector over said tubular rivets so as to provide an almost stepless adjustment of said fan motor speed over a relatively large rotational speed range.

2. A fan-heater appliance according to claim 1, including a supporting plate mounted in said housing for guiding the current collector, the tubular rivets extending through this supporting plate.

3. A fan-heater appliance according to claim 1, wherein said means for displacing said current collector includes a crank arrangement mounted to said housing for operating the current collector, the crank arrangement including a knurled disc for manipulation of the crank arrangement.

4. A fan-heater appliance according to claim 3, wherein the knurled disc extends at least partly out to the exterior through said housing of the appliance.

5. A fan-heater appliance according to claim 1, wherein said means for displacing said current collector includes a controller on said housing for operating the current collector.

* * * * *